US011667045B2

(12) United States Patent
Eijkelkamp

(10) Patent No.: US 11,667,045 B2
(45) Date of Patent: Jun. 6, 2023

(54) HAIR CUTTING DEVICE

(71) Applicant: KONINKLIJKE PHILIPS N.V., Eindhoven (NL)

(72) Inventor: Marcus Franciscus Eijkelkamp, Peize (NL)

(73) Assignee: KONINKLIJKE PHILIPS N.V., Eindhoven (NL)

( * ) Notice: Subject to any disclaimer, the term of this patent is extended or adjusted under 35 U.S.C. 154(b) by 0 days.

(21) Appl. No.: 16/979,551

(22) PCT Filed: Mar. 11, 2019

(86) PCT No.: PCT/EP2019/055962
§ 371 (c)(1),
(2) Date: Sep. 10, 2020

(87) PCT Pub. No.: WO2019/175081
PCT Pub. Date: Sep. 19, 2019

(65) Prior Publication Data

US 2021/0008741 A1 Jan. 14, 2021

(30) Foreign Application Priority Data

Mar. 16, 2018 (EP) ..... 18162268

(51) Int. Cl.
*B26B 19/20* (2006.01)
*B26B 19/38* (2006.01)

(52) U.S. Cl.
CPC ..... *B26B 19/205* (2013.01); *B26B 19/3886* (2013.01)

(58) Field of Classification Search
CPC ..... B26B 19/102; B26B 19/107; B26B 19/205; B26B 19/3886
(Continued)

(56) References Cited

U.S. PATENT DOCUMENTS 1,745,997 A * 2/1930 Kocourek et al. .... B26B 19/205 30/201
1,774,046 A * 8/1930 Wahl ..... B26B 19/205 30/201

(Continued)

FOREIGN PATENT DOCUMENTS

DE 1 090 544 B * 10/1960 ..... B26B 19/205
DE 2 161 809 A1 * 5/1973 ..... B26B 19/205

(Continued)

OTHER PUBLICATIONS

International Search Report and Written Opinion dated Jun. 19, 2019 For International Application No. PCT/EP2019/055962 Filed Mar. 11, 2019.

*Primary Examiner* — Jennifer S Matthews

(57) ABSTRACT

A hair cutting device kit including a detachable cutting unit actuator, and user-moveable control element. The cutting unit has an extension mechanism configured to vary a cutting length of the cutting unit within a cutting length range. The actuator is configured to cooperate with the extension mechanism of the cutting unit to vary a cutting length of the cutting unit, the actuator being moveable between a first actuator position corresponding to a first extreme cutting length, and a second actuator position corresponding to a second extreme cutting length. The control element is moveable between a range of length control positions between a first control position corresponding to the first actuator position and a second control position corresponding to the second actuator position, and an off position corresponding to deactivation of the drive. The actuator is in the first actuator position when the control element is in the off position.

20 Claims, 8 Drawing Sheets

(58) Field of Classification Search
USPC ..... 30/42, 44–46, 77–83
See application file for complete search history.

(56) References Cited

U.S. PATENT DOCUMENTS

| | | | | | |
|---|---|---|---|---|---|
| 2,182,597 | A * | 12/1939 | Oster | B26B 19/06 | 30/210 |
| 2,292,364 | A * | 8/1942 | Cromonic | B26B 19/205 | 30/201 |
| 2,726,447 | A * | 12/1955 | Maloy | B26B 19/205 | 30/202 |
| 3,093,901 | A * | 6/1963 | Wahl | B26B 19/205 | 30/201 |
| 3,280,456 | A * | 10/1966 | Erickson et al. | B26B 19/44 | 30/133 |
| 3,295,201 | A * | 1/1967 | Pucino | B26B 19/20 | 30/200 |
| 4,581,822 | A | 4/1986 | Fujimura | | |
| 4,669,189 | A | 6/1987 | Ullmann | | |
| 5,105,541 | A | 4/1992 | Messinger | | |
| 5,325,589 | A * | 7/1994 | Kubo | B26B 19/205 | 30/195 |
| 5,423,125 | A | 6/1995 | Wetzel | | |
| 6,601,302 | B2 | 8/2003 | Andrew | | |
| 6,742,262 | B2 * | 6/2004 | Rizzuto, Jr. et al. | B26B 19/205 | 30/201 |
| 8,341,846 | B1 | 1/2013 | Holmes | | |
| 2001/0004896 | A1 | 6/2001 | Chaouachi et al. | | |
| 2012/0272532 | A1 * | 11/2012 | Sobagaki et al. | B26B 19/205 | 30/201 |

FOREIGN PATENT DOCUMENTS

| | | | | |
|---|---|---|---|---|
| DE | 38 00 966 | A1 * | 7/1989 | B26B 19/205 |
| WO | 2016/005142 | | 1/2016 | |
| WO | 2016/071144 | | 5/2016 | |

* cited by examiner

HAIR CUTTING DEVICE

CROSS REFERENCE TO RELATED APPLICATIONS

This application is the U.S. National Phase application under 35 U.S.C. § 371 of International Application No. PCT/EP2019/055962 filed Mar. 11, 2019, which claims the benefit of European Patent Application Number 18162268.9 filed Mar. 16, 2018. These applications are hereby incorporated by reference herein.

FIELD OF THE INVENTION

The disclosure relates to a hair cutting device.

BACKGROUND OF THE INVENTION

Known hair cutting devices, such as beard trimmers and clippers, typically comprise a handle or drive unit which houses bulky components such as batteries and a drive system, and a cutting unit attached to the handle. In known cutting units, a toothed cutting blade engages a blade-facing surface of a guard, and can be driven to reciprocate over slots in the guard. In use, either the guard or a comb attached to the guard contacts the skin of the user.

In some cutting units, the guard may be moveable relative to the cutting blade to vary the cutting length. An adjustment means may be provided on the cutting unit, or in the handle for ease of control by a user. For example, an adjustment means in the form of an actuating lever may be provided in the handle to drive movement of the guard in the cutting unit.

It is to be noted that WO 2016/071144 A1 discloses a cutting unit which might be adjusted to vary the cutting length.

In known hair cutting devices, an adjustment means may lock the cutting unit at a selected cutting length, such that when a user detaches the cutting unit from the handle and subsequently re-attaches it, the cutting unit is restored to the selected cutting length.

Cutting units may be partially or wholly detachable from a handle, for example for cleaning, maintenance and replacement.

It is to be noted that U.S. Pat. No. 5,105,541 discloses an electric hair trimming apparatus having a spacer comb which is adjustable to vary the trimming length. The on-off control of this device is such that the device is turned off when the spacer comb is at the maximum length setting.

It is further to be noted that U.S. Pat. No. 4,669,189 discloses a hair cutting apparatus having an adjustable spacer comb, the on-off control of the hair cutting apparatus being integrated in the slide control of the spacer comb adjustment mechanism.

SUMMARY OF THE INVENTION

The invention is defined by the claims.

According to a first aspect of the disclosure there is provided a hair cutting device kit comprising a drive unit configured to receive a cutting unit comprising a follower element. The drive unit comprises a drive for driving a cutting unit mounted on the drive unit. The hair cutting device kit further comprising a cutting unit having an extension mechanism configured to vary a cutting length of the cutting unit within a cutting length range, and an actuator configured to cooperate with the extension mechanism of the cutting unit to vary a cutting length of the cutting unit within a cutting length range. The actuator is arranged to be moveable between a first actuator position corresponding to a first extreme cutting length of the cutting length range, and a second actuator position corresponding to a second extreme cutting length of the cutting length range. The hair cutting device kit further comprises a user-moveable control element moveable between a plurality of control positions including a range of length control positions between a first control position corresponding to the first actuator position and a second control position corresponding to the second actuator position, and an off position corresponding to deactivation of the drive, wherein the off position is adjacent the first control position. The cutting unit comprises a follower element configured to drive the extension mechanism and cooperate with the actuator so that, when the actuator engages the follower element, movement of the actuator between the first actuator position and the second actuator position causes corresponding variation of the cutting length between a first extreme cutting length of the cutting length range and a second extreme cutting length of the cutting length range. In use the actuator is in the first actuator position when the drive is deactivated by movement of the control element to the off position. The cutting unit is biased to return the follower element to a first follower position corresponding to engagement with the actuator in the first actuator position. The cutting unit is detachably mounted to the drive unit.

Accordingly, the control element combines length-setting and on/off functionality such that the actuator is restored to the first actuator position when the drive is deactivated. When the actuator is restored to the first actuator position, any attached cutting unit would be returned to a corresponding configuration. Accordingly, the restoration of the actuator to the first actuator position may pre-configure both the drive unit and the cutting unit to corresponding configurations for subsequent reattachment.

The control element may be a slider or dial (which may also be known as a zoomwheel), for example.

The control element and the actuator may be configured so that movement of the control element to the off position causes the control element or actuator to cooperate with a switch to deactivate the drive. Alternatively or additionally, the control element and the actuator may be configured so that movement of the control element away from the off position causes the control element or actuator to cooperate with a switch to activate the drive.

The control element may be moveable relative the actuator between the off position and the first control position to engage and disengage a switch controlling activation and deactivation of the drive.

According to a second aspect of the disclosure there is provided a hair cutting device kit comprising a drive unit in accordance with the first aspect and a cutting unit having an extension mechanism configured to vary a cutting length of the cutting unit within a cutting length range; wherein the cutting unit comprises a follower element configured to drive the extension mechanism and cooperate with the actuator so that, when the actuator engages the follower element, movement of the actuator between the first actuator position and the second actuator position causes corresponding variation of the cutting length between a first extreme cutting length of the cutting length range and a second extreme cutting length of the cutting length range.

Accordingly, when the drive is deactivated by movement of the control element to the off position, the actuator is restored to the first actuator position and the follower element cooperates with the actuator to restore the cutting unit to a corresponding configuration.

The drive unit and cutting unit may be configured so that when the cutting unit is mounted on the drive unit with the follower element in a first follower position corresponding to the first extreme cutting length and the actuator is in the second actuator position corresponding to the second extreme cutting length, the actuator and the follower element are disengaged such that movement of the actuator between the first and second actuator positions does not cause movement of the follower element between the first and second follower positions.

Accordingly, since the control element is configured to return the actuator to the first actuator position when the drive is deactivated, such disengagement between the actuator and the follower element upon mounting of the cutting unit on the drive unit may be prevented.

The cutting unit may comprise a blade carrier carrying a cutting blade, and the extension mechanism may comprise a guard moveable along the blade carrier to vary a cutting length of the cutting unit within the cutting length range. The follower element may be attached to the guard and configured to cooperate with the actuator so that movement of the actuator from the first actuator position to the second actuator position causes the guard to move from a first guard position corresponding to a first extreme cutting length to a second guard position corresponding to a second extreme cutting length.

The second extreme cutting length may correspond to a maximum cutting length of the cutting unit. Correspondingly, the first extreme cutting length may correspond to a minimum cutting length of the cutting unit.

The follower element may project towards the drive unit to engage the actuator. The follower element may be configured to project through an opening in the drive unit when the cutting unit is mounted on the drive unit The cutting unit and the drive unit have cooperating attachment points. For example, the attachment points may include a pivoting attachment point and/or a latching attachment point.

BRIEF DESCRIPTION OF THE DRAWINGS

Embodiments of the invention will now be described, by way of example, with reference to the accompanying drawings, in which.

DETAILED DESCRIPTION OF THE EMBODIMENTS

Figure 1:
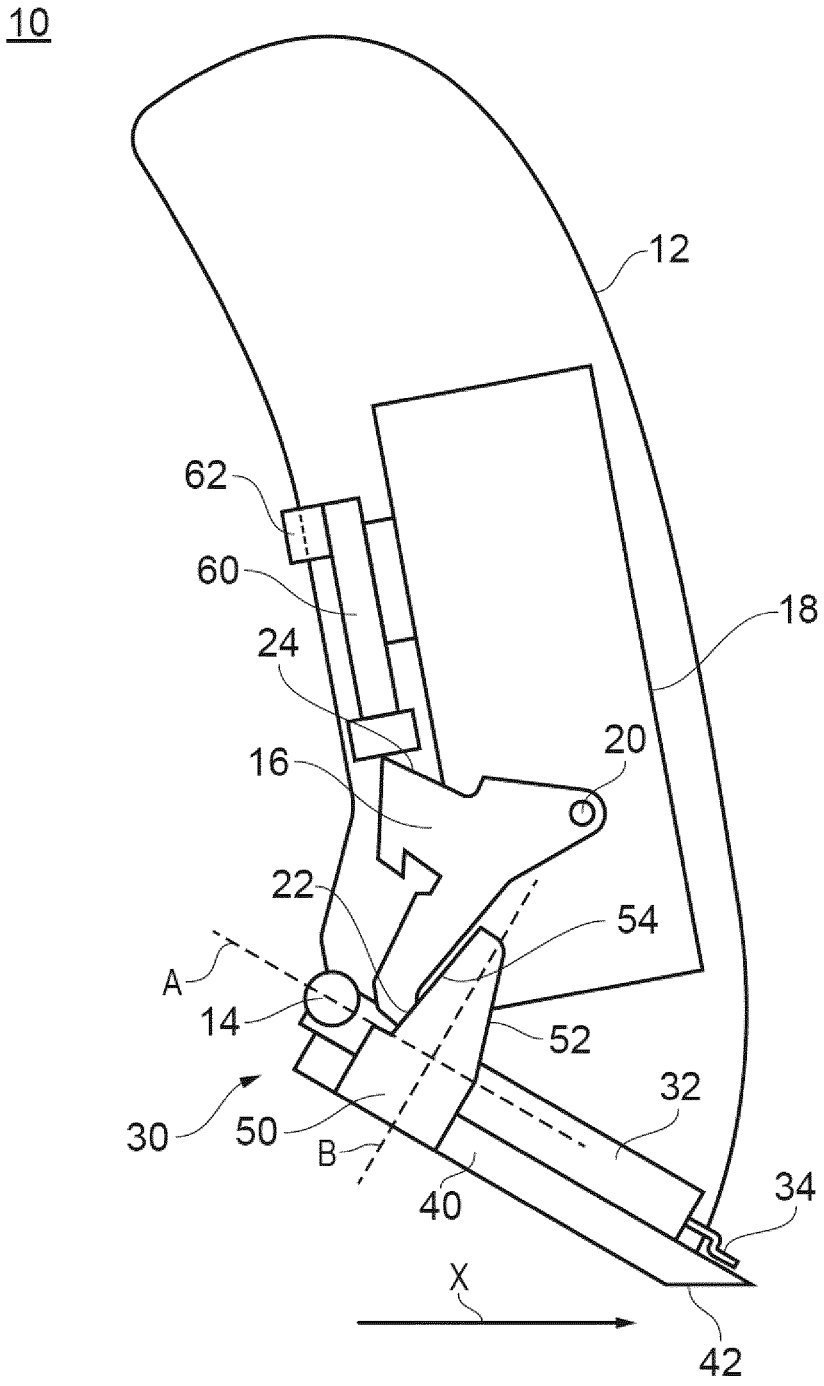
FIG. 1 schematically shows a cross-sectional view of a cutting device.

FIG. 1 shows a cutting device 10 comprising a drive unit 12 and a cutting unit 30 pivotably coupled to the drive unit 12 at a pivot 14. In this example, the cutting unit 30 and the drive unit 12 have cooperating attachment points which are detachably attachable at the pivot 14 to define a pivot axis for pivoting movement of the cutting unit 30 relative the drive unit 12. In other examples the cutting unit 30 may be provided together with the drive unit 12 such that they are not intended to be detached by a user (i.e. they are effectively permanently attached).

As shown schematically in FIG. 1, the drive unit 12 comprises an actuator 16 which in this example is rotatable relative a housing of the drive unit 12 from a first actuator position corresponding to a shortest cutting length of the cutting unit 30 to a second actuator position corresponding to a longest cutting length of the cutting unit 30, as will be described in detail below with respect to FIG. 3.

In this example, the actuator 16 is generally in the form of a lever rotatable about an actuator pivot 20 supported on the housing of the drive unit 12. The actuator has a first arm extending from the actuator pivot 20 to an actuation point 22 for engaging the cutting unit 30, as will be described below. In this example, the first arm is substantially elongate with a head that projects in the direction of rotating motion to the second actuator position (i.e. anti-clockwise in FIG. 1) to define the actuation point.

In this example, the actuator 16 further comprises a second arm extending from the actuator pivot 20 to a drive input point 24 for receiving a driving force to move the actuator 16 from the first actuator position to the second actuator position. For example, the drive input point 24 may be driven by a length-setting mechanism of the drive unit 12.

In this example, the length-setting mechanism comprises a control element in the form of a slider 60 slidably mounted in the drive unit 12 and configured to slide between first and second control positions to cause corresponding movement of the actuator 16 from the first actuator position to the second actuator position. The slider 60 is in the form of a piston having a head which engages the drive input point 24 of the actuator 16. A slide button 62 protrudes from a side of the piston and through a slot in the wall of the drive unit 12.

The drive unit 12 further comprises a drive 18 for driving the cutting unit 30. In this example, the drive 18 comprises a motor and a blade drive (not shown) which extends from the motor to engage driven elements of the cutting unit 30, in particular a reciprocating cutting blade.

FIG. 1 shows the cutting unit 30 mounted on the drive unit 12. In this particular example, the cutting unit 30 is pivotable relative the drive unit 12, and is mounted on the drive unit so as to be driven by the drive when it is in a closed position as shown in FIG. 1 in which it extends along and is retained against a lower end of the drive unit 12. For example, in the closed position the cutting unit 30 may be retained against the drive unit 12 by attachment at the pivot 14, and by one or more other fasteners, such as mutually engaging snap-fit formations on the cutting unit 30 and the drive unit 12 respectively. In the closed position, the cutting unit 30 may align with the blade drive of the drive unit 12 for driving reciprocating motion of a cutting blade of the cutting unit.

The cutting unit 30 comprises a blade carrier 32 configured to detachably attach to the drive unit 12 at the pivot 14 and extend along the lower end of the housing 12 in the closed position. The blade carrier 32 holds a blade 34 which extends from a forward end of the blade carrier 32 (the right side as shown in FIG. 1). In this example, the blade 34 has a toothed cutting edge configured for transverse reciprocation along a transverse axis parallel with a pivot axis of the pivot 14.

The cutting unit 30 further comprises a guard 40 coupled to the blade carrier 32 so that the guard 40 is slideable relative to the blade carrier 32 along an extension axis A (the extension axis A is shown in FIG. 1 as intersecting the pivot 14). As shown in FIG. 1, in this example the guard 40 extends along a lower side of the blade carrier 32. It has a squat substantially cuboidal body which is chamfered on its lower side to define a forward tip that protrudes forwardly from the blade carrier 32. The guard 40 has a substantially planar upper blade-facing surface which faces and engages the cutting blade 34 to define a cut location of the cutting unit.

The forward tip of the guard 40 has a guard contact surface 42 for engaging skin of a user, which is inclined with respect to the upper blade-facing surface (and with respect to the lower blade-facing surface), for example at an angle of between 15 and 45°. In this particular example, the guard contact surface 42 is inclined with respect to the blade-facing surface at an angle of approximately 30°.

The guard contact surface 42 is substantially planar and is for engaging skin of a user during cutting, though in other examples other profiles may be used. When the guard contact surface 42 engages skin of a user, a cutting length of the cutting unit 30 is equal to the distance between the guard contact surface 42 and the cut location along an axis B perpendicular to the guard contact surface 42. In other examples, a comb may be provided over the guard.

As the guard 40 is slideable along the extension axis A, the cutting length is variable. FIG. 1 shows the guard in a first guard position corresponding to a shortest cutting length of the cutting unit. In this example, the guard 40 is biased to the first guard position, for example by a spring acting between the blade carrier 32 and the guard 40 (or the follower element, as will be described below), or any suitable biasing means. There may be a stop acting between the guard and the blade carrier which defines the first guard position to which the guard is biased.

By biasing the guard to a predetermined position relative the blade carrier 32 (and thereby the blade 34), the relative position of the guard and the blade 34 may be set with relatively high accuracy. This accuracy may be relatively high in comparison with guard positions away from the biased position, which may depend on manufacturing tolerances of the various components along the transmission between the user input (e.g. a user-engageable slider) and the guard, such as the actuator, follower element, blade carrier, blade and the guard itself. In contrast, the predetermined position may be determined, for example, by simple abutment of the guard with a stop on the blade carrier 32, which directly determines the relative position of the guard and the blade carrier 32, and thereby the blade 34.

In this example, as the guard 40 is biased to the first guard position corresponding to the shortest cutting length of the cutting unit, the shortest cutting length may be set with relatively high accuracy. This may be advantageous as the shortest cutting length may have the lowest margin for error. In other words, an absolute error would translate into a higher percentage error for the shortest cutting length than a longest cutting length.

The cutting unit 30 further comprises a follower element 50 which is configured to engage the actuator 20 of the drive unit 12 to drive sliding movement of the guard 40 relative the blade carrier. In this example, the follower element 50 is fixedly attached to the guard 40 so that the guard 40 and follower element 50 are constrained to move along the extension axis A together. The follower element 50 may be coupled to the guard 40 in any suitable way. For example, the follower element 50 may be clipped to the guard 40, may engage cooperating formations of the guard 40 (for example by a snap-fit connection), or may be coupled to the guard by a mechanical fastener, such as a screw.

As shown in FIG. 1, the follower element 50 has a contact member 52 which protrudes from a body of the follower element 50 towards the drive unit 12. In this example, the follower element is configured to project through an opening in the drive unit when the cutting unit is in the closed position.

The contact member 52 projects from the extension plane towards the drive unit 12 to define a contact surface 54 for engaging the actuator 20. In this particular example, the contact surface 54 is generally planar and is inclined relative a plane normal to the extension axes A by an acute angle, for example approximately 10°. In other words, a normal axis of the contact surface is inclined with respect to the extension axis by an acute angle (for example approximately 10°) and lies in a plane normal to the pivot axis. In other examples, the contact surface 54 may be curved.

Figure 2:
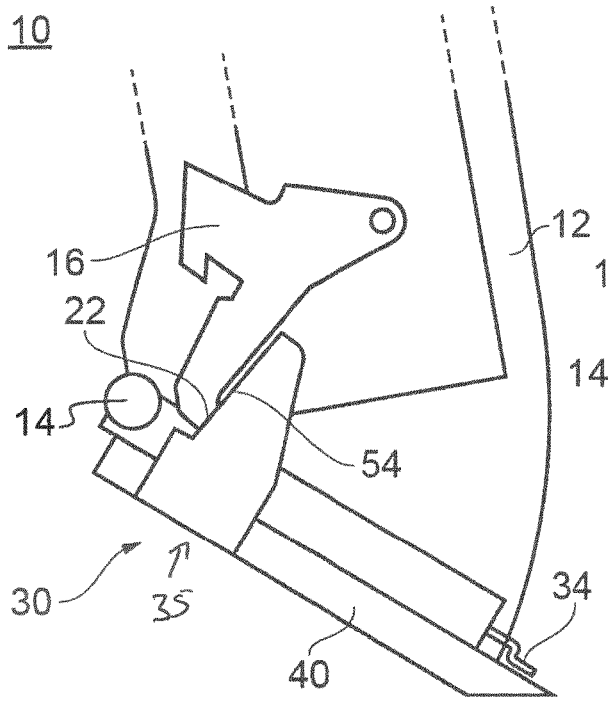
FIGS. 2 and 3 schematically show the cutting device with the guard of the cutting unit in a first position corresponding to a shortest cutting length (FIG. 2), and a second position corresponding to a longest cutting length (FIG. 3), respectively.
Figure 3:
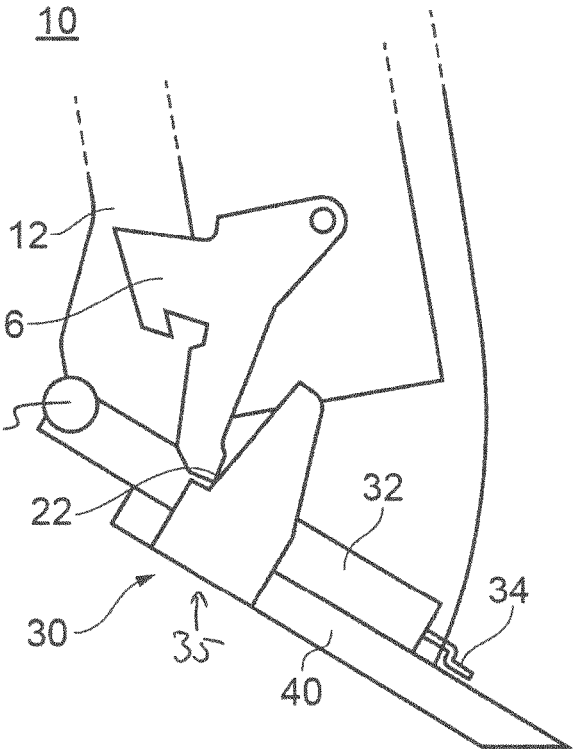

FIGS. 2 and 3 show partial cross-sectional views of the cutting device 10 with the guard 40 in a first guard position corresponding to a shortest cutting length of the cutting unit 30 (FIG. 3), and a second guard position corresponding to a longest cutting length of the cutting unit 30 (FIG. 3).

The cutting unit 30 has a range of cutting lengths, and the first and second guard positions correspond to two extremes of the range of cutting lengths: i.e. a shortest cutting length and a longest cutting length.

As shown by comparison of FIGS. 2 and 3, in use the actuator 16 is rotated about the actuator pivot 20 (in an anti-clockwise position as shown in the drawings) to move from a first actuator position corresponding to the shortest cutting length to a second actuator position corresponding to the longest cutting length.

In the first actuator position the actuation point 22 of the actuator engages the contact surface 54 of the follower element 50 at a contact point with the follower element 50 in a first follower position.

The pivoting movement of the actuator from the first actuator position to the second actuator position causes the actuation point 22 to push the follower element 50, and thereby the guard 40, to slide to a second follower position and a second guard position respectively as shown in FIG. 3, corresponding to the longest cutting length.

In use, the actuator 16 can return from the second actuator position to the first actuator position (or to any position therebetween). In this example, the guard is biased to the first guard position corresponding to the shortest cutting length, and so the guard 40 moves back from the second guard position towards the first guard position under action of the biasing force, as permitted by returning movement of the actuator 16.

Figure 4:
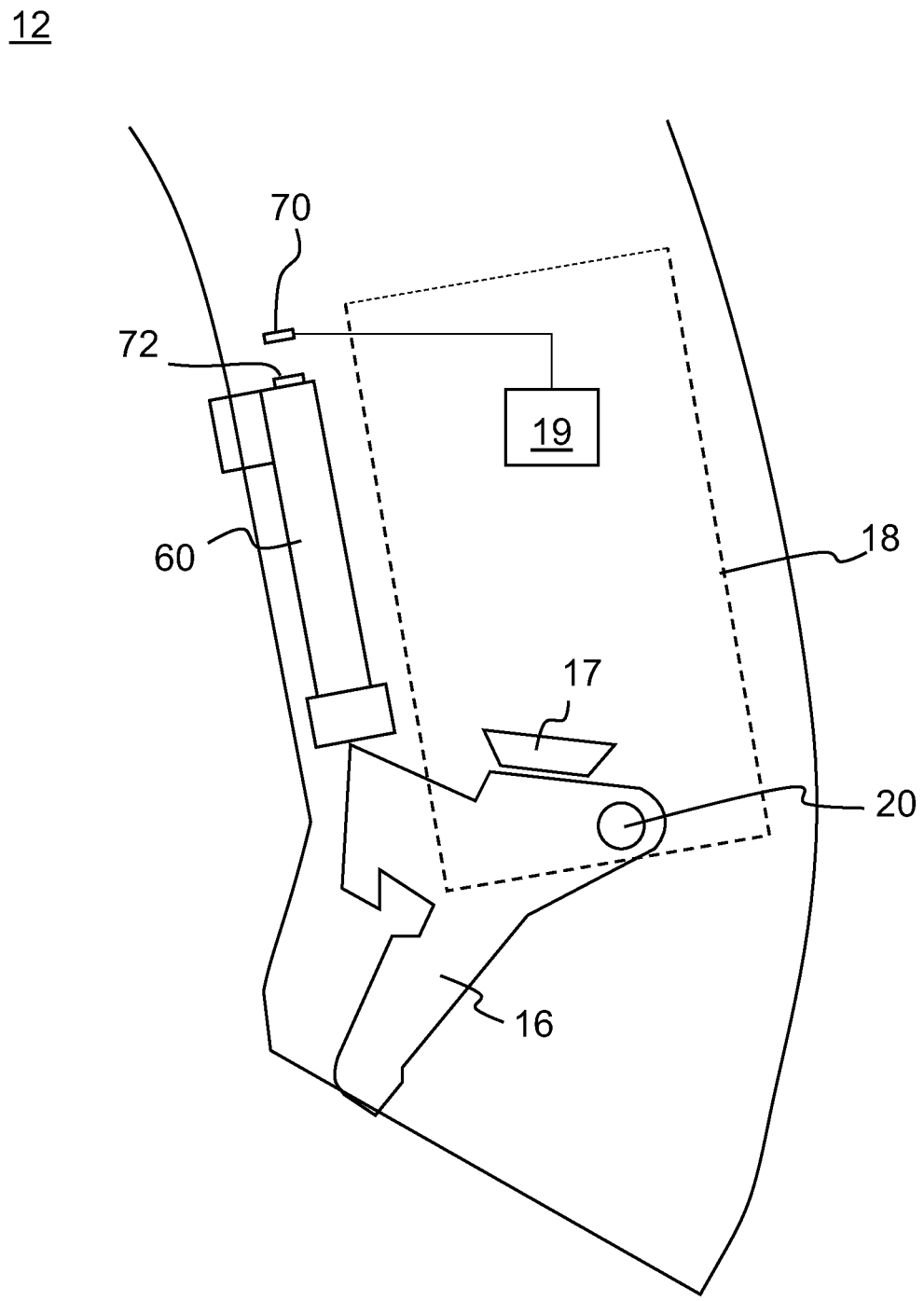
FIGS. 4-6 schematically show selected components of an example cutting device with a control element in a first control position, a second control position and an off position respectively and an actuator in a first actuator position.
Figure 5:
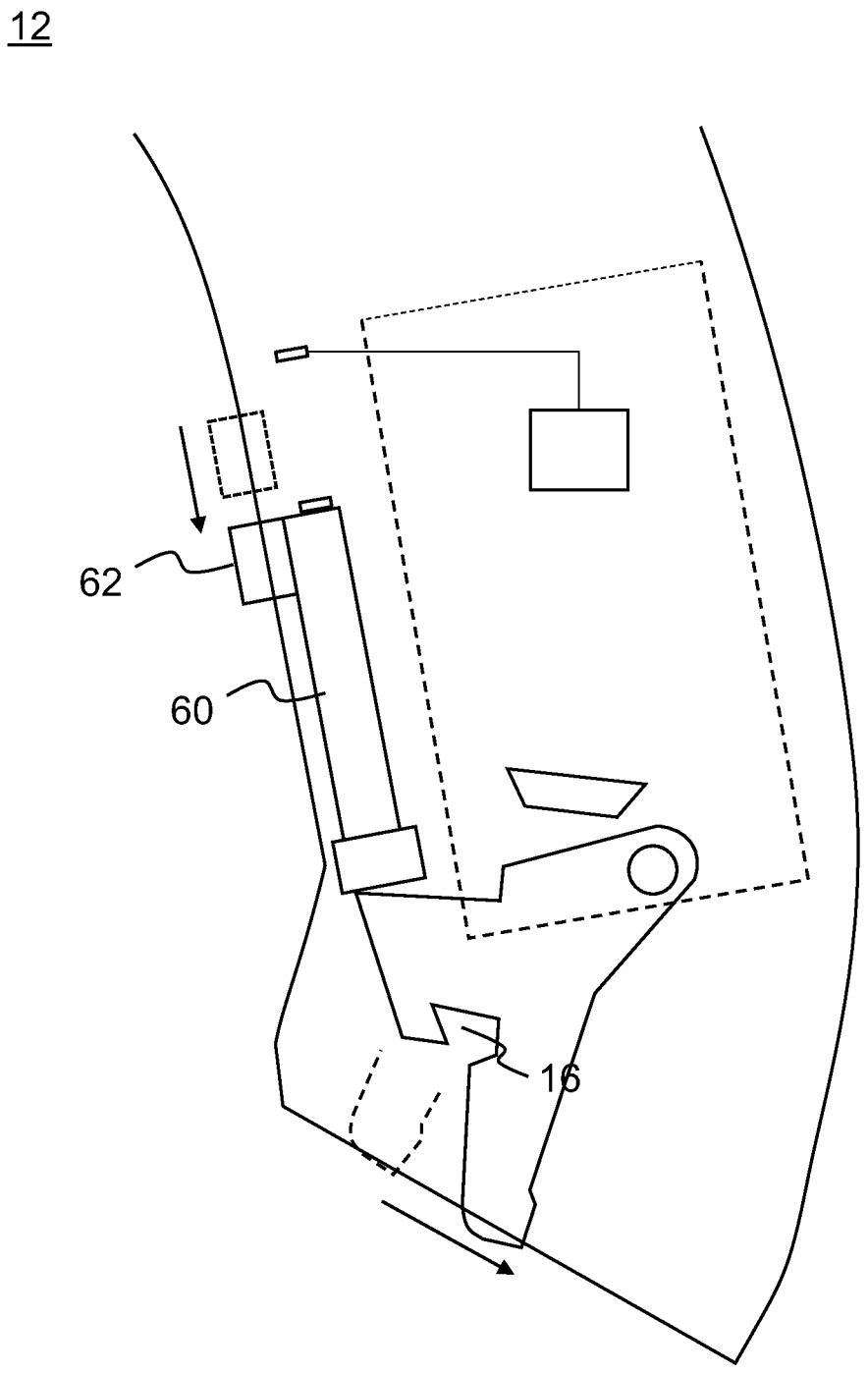
Figure 6:
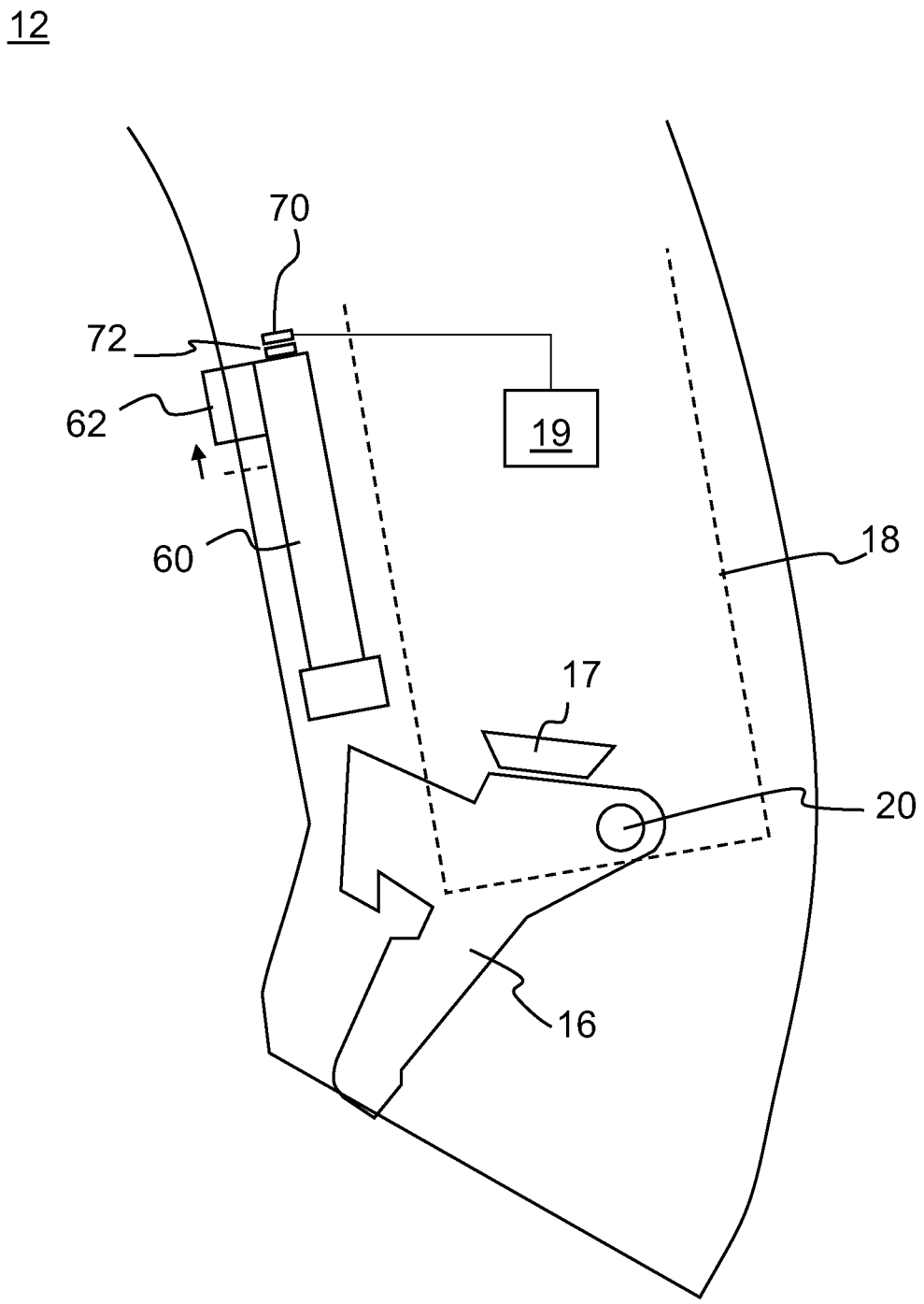

FIGS. 4-6 show various configurations of the drive unit 12 as the control element 60 is moved between an off position and a range of control positions to cause corresponding movement of the actuator. FIGS. 4-6 show selected features of the drive unit 12 in additional detail to FIGS. 1-3, and omits other features for clarity of the drawings.

As shown in FIG. 4, the drive 18 comprises a drive controller 19 coupled to a switch element 70. A corresponding switch element 72 is provided on the control element 60 to define a switching arrangement. The controller 19 is configured to control activation and deactivation (i.e. turning on and off) the motor of the drive 18 in response to disengagement and engagement of the switch elements 70, 72.

In this particular example, the switching arrangement defines a proximity switch configured to deactivate the drive 18 when the switch elements 70, 72 engage one another, and to activate the drive 18 when the switch elements 70, 72 are separated. For example, the proximity switch may comprise a Hall sensor. However, it will be appreciated that in other examples any suitable switching arrangement can be used, including mechanical switches, or a switching arrangement based the output of an encoder (e.g. a linear encoder) responsive to the position of the control element 60 or the actuator 16, for example.

FIG. 4 shows the drive unit 12 with the control element 60 in a first control position of the range of length control positions. In the first control position, the switching elements 70, 72 are disengaged such that the drive is activated.

In this example, the actuator 16 is biased by a rotational spring at the actuator pivot 20 towards the control element 60 such that when the control element is moved away from the actuator 16, the actuator 16 follows movement of the control element. In other examples, the actuator 16 may be configured to follow movement of the control element by an alternative configuration, for example by engagement with the control element by a pin-slot mechanism. Accordingly, when the control element is in the first control position, the actuator 16 is in the first actuator position which corresponds to the shortest cutting length of the cutting unit 30 as described above.

In this example, the drive unit 12 comprises an actuator stop 17 configured to stop movement of the actuator from the second actuator position towards the first actuator position at the first actuator position.

Movement of the control element 60 to a second control position of the range of control positions causes it to act on the actuator 16 to cause it to move from the first actuator position as shown in FIG. 4 to the second actuator position as shown in FIG. 5.

By way of comparison, FIG. 5 shows the position of the slide button 62 of the control element in both solid lines corresponding to the second control position and dashed lines corresponding to the first control position. Similarly, the actuator 16 is shown in the second actuator position in solid lines, and the end of the first arm of the actuator is also shown in dashed lines corresponding to the first actuator position.

As shown in FIG. 5, movement of the actuator 16 to the second control position causes it to move away from the actuator stop 17.

FIG. 6 shows the drive unit 12 with the control element moved to an off position from the first control position. The off position is adjacent the first control position and outside the range of length control positions of the control element. By way of comparison, FIG. 6 shows the slide button 62 of the control element in solid lines corresponding to the off position, and an end of the slide button in dashed lines corresponding to the first control position.

Since the actuator 16 is stopped in the first actuator position when the control element 60 is in the first control position, the actuator does not follow the control element as it moves to the off position.

When the control element 60 is in the off position, the switch element 72 on the control element engages the switch element 70 coupled to the drive controller 19 so that the drive controller deactivates the drive.

The example drive unit 12 described above is one example of a drive unit in which a user-moveable control element is moveable between a plurality of control positions including a range of length control positions between a first control position corresponding to a first actuator position and a second control position corresponding to the second actuator position; and an off position corresponding to deactivation of the drive, which is adjacent the first control position.

In this particular example, the control element is configured to move together with the actuator over the range of length control positions, and moves independently of the actuator to the off position.

However, as mentioned above, in other examples the drive unit may be configured differently. In particular, any suitable switching arrangement, control element and mode of cooperation between the control element and an actuator may be used.

Figure 7:
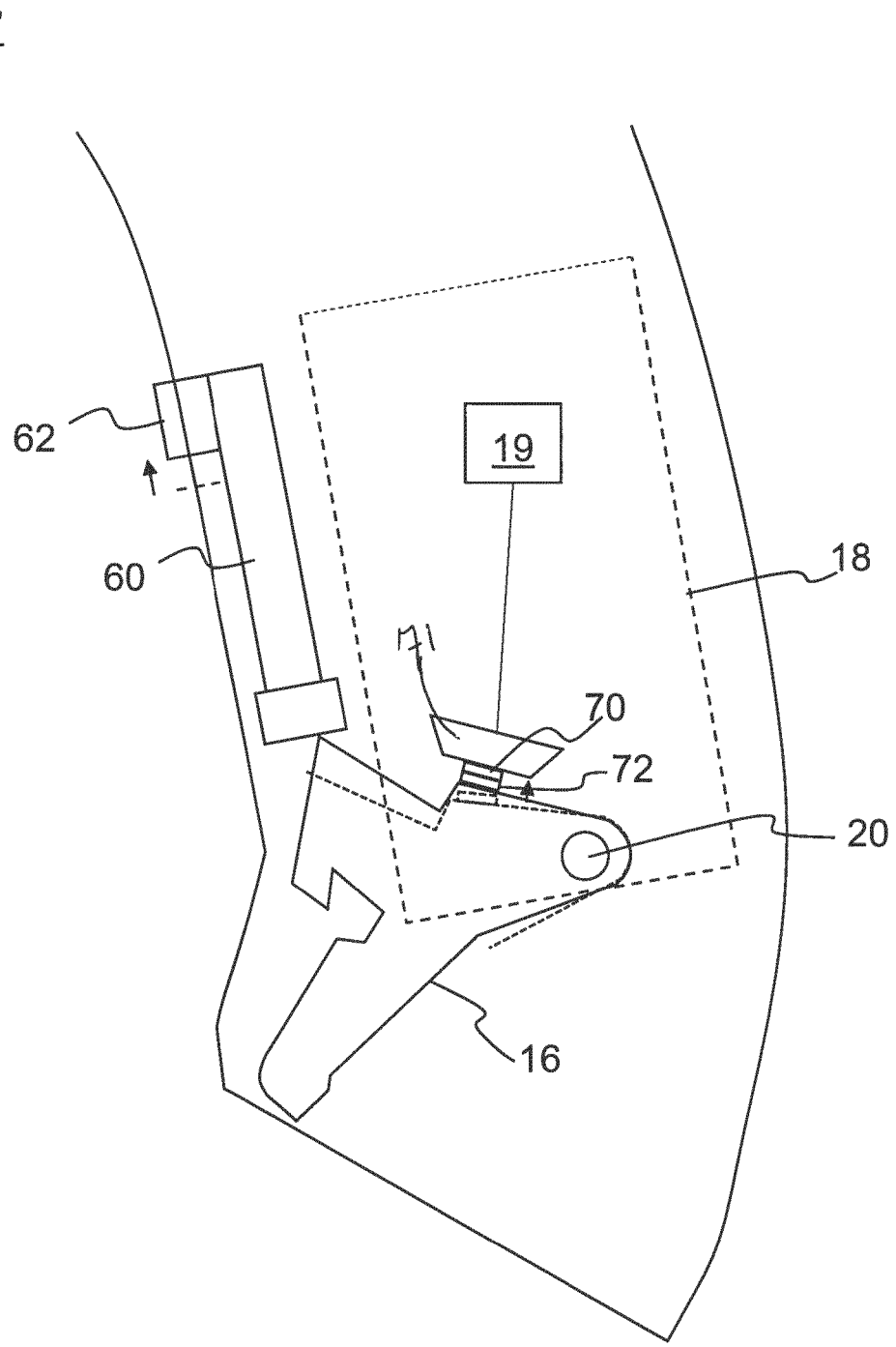
FIG. 7 schematically show selected components of a further example cutting device with the control element in the off position.

By way of example, FIG. 7 shows a further example drive unit 12' which differs from the drive unit 12 described above with respect to FIGS. 4-6 in aspects relating to the switching arrangement and cooperation between the control element and the actuator.

In this example, the control element 60 is substantially as described above but is not provided with a switching element.

FIG. 7 shows the drive unit 12' with the control element in an off position. By way of comparison, the position of the slide button 62 of the control element 60 is shown in solid lines corresponding to the off position, and an end of the slide button 62 is shown in dashed lines corresponding to the first control position.

In this example, the actuator 16 is rotationally biased to follow the control element 60 as described above. However, in this example, the actuator is not stopped in the first actuator position and so the actuator 16 is moveable from the first actuator position to an actuator off position corresponding to the off position of the control element 60. By way of comparison, FIG. 7 shows the actuator 16 in the actuator off position in solid lines, with selected edges of the actuator 16 shown in dashed lines corresponding to the first actuator position.

As shown in FIG. 7, in this example a switching arrangement is provided in which the drive controller 19 is coupled to a switch element a switch element 70 is provided on a support 71 configured to oppose the actuator in the actuator off position, and a corresponding switch element 72 is provided on an opposing portion of the actuator such that the switch elements 70, 72 engage when the actuator 16 is in the actuator stop position.

The drive controller 19 is configured so that, when the control element 60 is in the off position such that the actuator is in the actuator off position, the switch element 72 on the actuator engages the switch element 70 coupled to the drive controller 19 so that the drive controller 19 deactivates the drive.

When the control element 60 moves from the off position to the first control position or any control position within the range of length control positions, the switch element 72 on the actuator disengages the switch element 70 coupled to the drive controller 19 such that the drive controller activates the drive. As described above, in other examples any suitable switching arrangement may be used.

Figure 8:
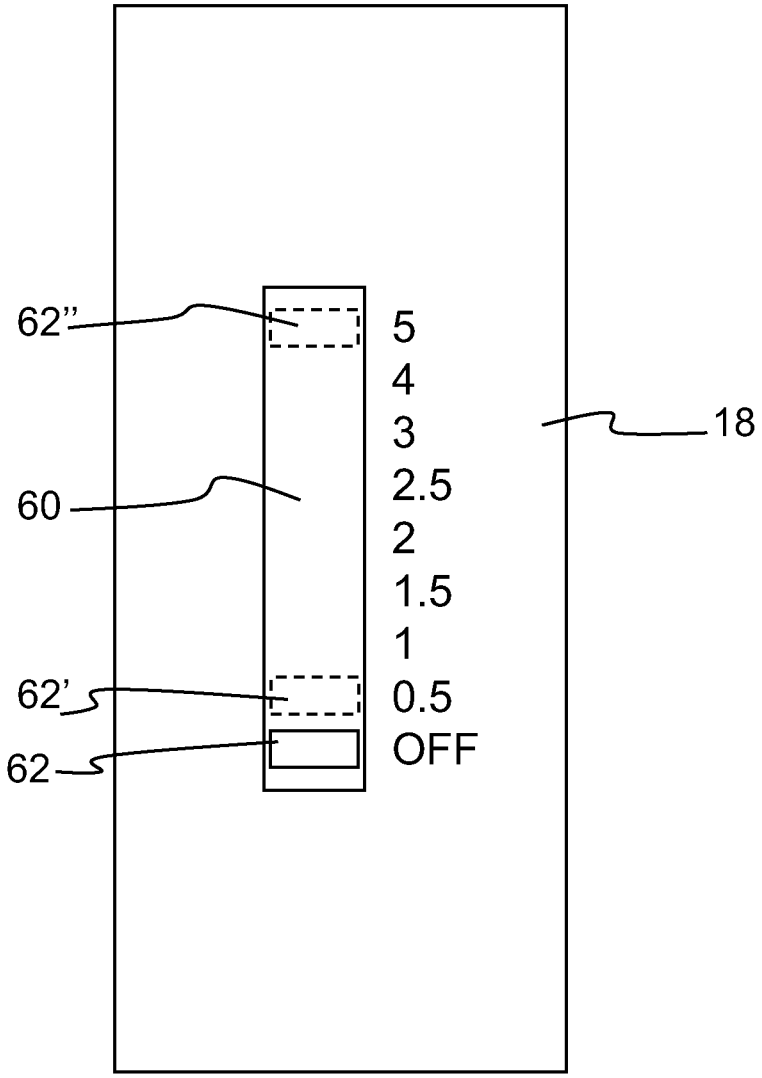
FIGS. 8 and 9 show two example control elements.

FIG. 8 shows a partial external view of the slideable control element 60 according to the examples described above. The housing of the drive unit 12 comprises a window through which the control element is accessible by a user. As described above, in this example the control element 60 comprises a slideable member provided with a slide button 62 which protrudes through the wall of the housing so that a user can engage it, for example with their thumb.

FIG. 8 shows markings indicating control positions for the slider button 62. The markings indicate a range of length control positions from a first control position corresponding to a minimum cutting length of 0.5 (i.e. 0.5 mm) to a second control position corresponding to a maximum cutting length of 5 (i.e. 5 mm). The off position is adjacent the range of length control positions, and in particular is adjacent the first control position corresponding to the minimum cutting length (of 0.5 mm).

In other examples, the off position may be adjacent a control position corresponding to either extreme of a cutting length range: i.e. either the minimum or the maximum.

FIG. 8 shows the slider button 62 in the off position in solid lines. The slider button 62 is moveable to the first and second control positions as described above, and is shown in dashed lines in those positions.

Figure 9:
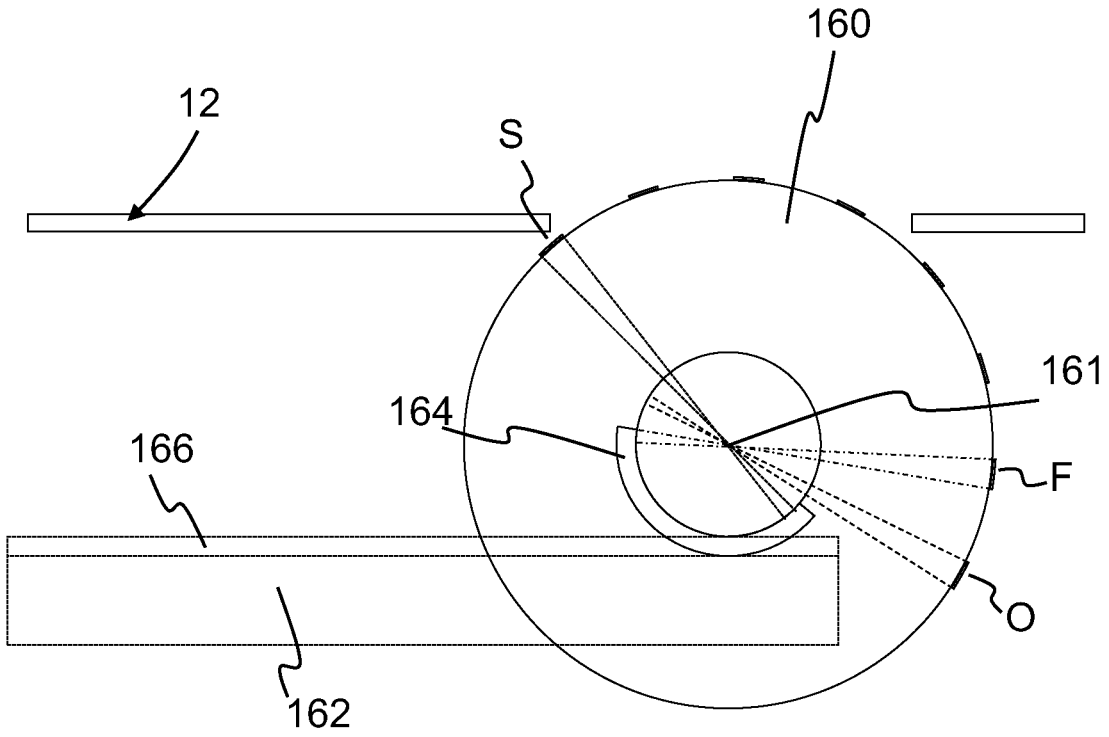

In other examples, other types of control element may be provided. FIG. 9 shows a partial cross-sectional view variant of the drive unit 12 which is substantially as described but differs in aspects relating to the particular configuration of the control element 160 and the actuator 116.

In this example, the control element 160 comprises a dial, otherwise known as a zoomwheel. In this example, the dial 160 is rotatable about a rotation axis 161 and engages a linearly-moveable slider 162 of the control element by a rack and pinion mechanism therebetween. In this example, the linearly moveable slider 162 is configured to engage an actuator in substantially the same way as the slider 60 of the examples described above engages the actuator 16 of the same examples. However, in other examples, the linearly moveable slider 162 of FIG. 9 may directly engage a follower element of a cutting unit.

As shown by way of example in FIG. 9, the dial 160 comprises a plurality of raised markings corresponding to different control positions of the control element (although in other examples the markings need not be raised). These include an off position marking O, a first control position marking F and a second control position marking S. The dial is in the respective control position (i.e. the off position, first control position or the second control position) when it is rotated such that the respective marking is in the center of a window in the housing of the drive unit 12. The housing of the drive unit 12 may comprise a marking indicating the center position of the window.

As shown schematically in FIG. 9, the dial 160 comprises a pinion wheel including an arcuate set of teeth 164 configured to mesh with a corresponding linearly-extending set of teeth 166 on the slider 162—such that a rack and pinion mechanism is formed between the dial 160 and the slider 162.

In this particular example, the arcuate set of teeth 164 extend over a range of the pinion wheel corresponding to the range of length control positions of the control element between the first control position and the second position. In this example, the pinion wheel is configured to engage the slider 162 at an angular position diametrically opposed to the center position of the window, such that the pinion teeth corresponding to each marking and control position are diametrically opposed to the respective marking.

In this example, the arcuate set of teeth extend over a range of the pinion wheel diametrically opposing the range of length control position markings (F-S), but terminate before a position diametrically opposing the off position. Accordingly, when the dial 160 is rotated from the first control position to the off position, no teeth on the pinion engage the teeth on the slider 162. Accordingly, in this particular example the slider remains in a first slider position corresponding to the first control position of the dial 160 when the dial 160 is rotated from the first control position to the off position.

However, in other examples, the teeth on the pinion wheel may be configured to cooperate with the teeth on the slider 162 as the dial 160 is moved between the first control position to the off position so that such movement causes corresponding movement of the slider. In at least some of such examples, the slider may engage an actuator which is configured to engage an actuator stop in the first actuator position, such that the actuator does not follow movement of the slider 162 when the dial moves from the first control position to the off position.

A switching arrangement may be provided which engages the dial 160, the slider 162 or a corresponding actuator to control deactivation and activation of the drive as described above.

In each of the above examples, the control element combines length-setting and on/off functionality of the drive unit. Further, the on/off functionality is provided by moving the control element between an off position and the first control position in a range of length control positions.

Accordingly, in use the control element is returned to the first control position immediately before the drive is deactivated, such that the actuator returns to the first actuator position, and an extension mechanism of a cutting unit mounted on the drive unit returns to a configuration corresponding to a first extreme cutting length (which may be a shortest or a longest length of a cutting length range).

Such an arrangement provides several advantages concerning the cooperation of the drive unit and a cutting unit, particularly concerning attachment of a cutting unit.

As described above, when a length-setting mechanism is provided in a drive unit, a component in the drive unit engages a component of an attached cutting unit. In the examples described above, the actuator engages a follower element of the cutting unit.

The applicant has recognized a problem concerning such cooperating features, in that the cutting unit may now function properly or may be damaged when the follower element and the actuator are not in corresponding positions when the cutting unit is mounted onto the drive unit.

In previously-considered cutting devices, on/off functionality is provided separately from length-setting functionality. This may enable a user to maintain the length-setting mechanism at a preferred setting, even when the cutting unit is detached for maintenance. However, it may be difficult to align the cooperating features of the drive unit and the cutting unit for reattachment. The applicant has considered arrangements which permit an actuator to remain in a position corresponding to a preferred length-setting (e.g. which may be an intermediate position) and to engage a follower element of a cutting unit upon attachment of cutting unit to the drive unit to restore the cutting unit to a configuration corresponding to the length-setting. However, such arrangements may be complex and may rely on a particular sequence mode and sequence of assembly, such as attachment of a cutting unit at a pivot point, and pivoting to a closed position as described above with respect to FIG. 1. Further, such arrangements may rely on the cutting unit being biased to a particular configuration.

By combining the on/off functionality and length-setting functionality of the control element as described herein, the actuator of the drive unit is always returned to the same position (the first actuator position) when the drive is deactivated for detaching the cutting unit. This also causes the cutting unit to be returned to a corresponding configuration (e.g. by returning the follower element to the first follower position) prior to detachment of the cutting element.

Accordingly, when a user comes to reattach a cutting unit to the drive unit, the actuator remains in the first actuator position and the cutting unit should remain in a corresponding configuration for attachment.

In some examples, a cutting unit may be biased to a configuration corresponding to the first control position—e.g. it may be biased to return the follower element to a first follower position corresponding to engagement with the actuator in the first actuator position (and/or an actuator off position). Accordingly, in such examples the cutting unit is restored to a configuration for engagement with the actuator of a drive unit in a deactivated state, even if the moving parts of the cutting unit are manipulated whilst the cutting unit is detached, for example for maintenance and cleaning.

While the invention has been illustrated and described in detail in the drawings and foregoing description, such illustration and description are to be considered illustrative or exemplary and not restrictive; the invention is not limited to the disclosed embodiments. Various alternative examples are discussed throughout the detailed description.

Other variations to the disclosed embodiments can be understood and effected by those skilled in the art in practicing the claimed invention, from a study of the drawings, the disclosure, and the appended claims. In the claims, the word "comprising" does not exclude other elements or steps, and the indefinite article "a" or "an" does not exclude a plurality. Any reference signs in the claims should not be construed as limiting the scope.

The invention claimed is:

1. A hair cutting device comprising:

a cutting unit having a guard, the guard being configured to vary a cutting length of the cutting unit within a cutting length range;

a drive unit that receives the cutting unit, the drive unit comprising:

a motor for driving the cutting unit;

an actuator configured to cooperate with the guard of the cutting unit to vary the cutting length of the cutting unit within the cutting length range, the actuator being moveable between a first actuator position corresponding to a first extreme cutting length of the cutting length range, and a second actuator position corresponding to a second extreme cutting length of the cutting length range;

a user-moveable control element moveable between a plurality of control positions including:

a range of length control positions between a first control position corresponding to the first actuator position and a second control position corresponding to the second actuator position; and an off position corresponding to deactivation of the motor, wherein the off position is adjacent the first control position;

wherein the cutting unit comprises a follower element connectable to the guard and configured to drive the guard and cooperate with the actuator so that, when the actuator engages the follower element, movement of the actuator between the first actuator position and the second actuator position causes movement of the follower element which causes movement of the guard, resulting in a corresponding variation of the cutting length between the first extreme cutting length of the cutting length range and the second extreme cutting length of the cutting length range;

whereby, in use, the actuator is in the first actuator position when the drive is deactivated by movement of the user-moveable control element to the off position, such that the follower element moves to a first follower position corresponding to engagement with the actuator in the first actuator position; and wherein the cutting unit is detachably mounted on the drive unit.

2. The hair cutting device according to claim 1, wherein the user-moveable control element is a slider or a dial.

3. The hair cutting device according to claim 1, wherein the user-moveable control element and the actuator are configured so that movement of the user-moveable control element to the off position causes the user-moveable control element or the actuator to cooperate with a switch to deactivate the motor; and/or wherein the user-moveable control element and the actuator are configured so that movement of the user-moveable control element away from the off position causes the user-moveable control element or the actuator to cooperate with the switch to activate the motor.

4. The hair cutting device according to claim 1, wherein the user-moveable control element is moveable relative the actuator between the off position and the first control position to engage and disengage a switch controlling activation and deactivation of the motor.

5. The hair cutting device according to claim 1, wherein the drive unit and cutting unit are configured so that when the cutting unit is mounted on the drive unit with the follower element in a second follower position corresponding to the second extreme cutting length and the actuator in the first actuator position corresponding to the first extreme cutting length, the actuator and the follower element are disengaged such that movement of the actuator between the first and second actuator positions does not cause movement of the follower element between the first follower position and the second follower position.

6. The hair cutting device according to claim 1, wherein the cutting unit comprises a blade carrier carrying a cutting blade, and wherein the guard is moveable along the blade carrier to vary the cutting length of the cutting unit within the cutting length range;

wherein the follower element is attached to the guard and configured to cooperate with the actuator so that movement of the actuator from the first actuator position to the second actuator position causes the guard to move from a first guard position corresponding to the first extreme cutting length to a second guard position corresponding to the second extreme cutting length.

7. The hair cutting device according to claim 1, wherein the second extreme length corresponds to a maximum cutting length of the cutting unit.

8. The hair cutting device according to claim 1, wherein the follower element projects towards the drive unit to engage the actuator.

9. The hair cutting device according to claim 8, wherein the follower element is configured to project through an opening in the drive unit.

10. The hair cutting device according to claim 1, wherein the cutting unit and the drive unit have a pivoting attachment point.

11. The hair cutting device according to claim 1, wherein the actuator comprises an arm extending from the motor of the drive unit to the guard.

12. The hair cutting device according to claim 11, wherein the actuator comprises an additional arm extending from the motor of the drive unit to a drive input point for receiving a driving force to move the actuator from the first actuator position to the second actuator position.

13. The hair cutting device according to claim 12, wherein the user-moveable control element includes a piston that engages the drive input point to cause movement of the actuator between the first actuator position to the second actuator position.

14. The hair cutting device according to claim 1, wherein the follower element has a contact surface for engaging the actuator.

15. The hair cutting device according to claim 1, further comprising:

a first switch element coupled to the motor;

a second switch element provided on the user-moveable control element, wherein a drive controller is configured to control activation and deactivation of the motor in response to disengagement and engagement of the first and second snitch elements.

16. The hair cutting device according to claim 1, further comprising an actuator stop configured to stop movement of the actuator from the second actuator position towards the first actuator position at the first actuator position.

17. A hair cutting device comprising:

a cutting means having a guard means, the guard means for varying a cutting length of the cutting means within a cutting length range;

a drive means for receiving the cutting means, the drive means comprising: a motor for driving the cutting means;

an actuator means for cooperating with the guard means to vary the cutting length of the cutting means within the cutting length range, the actuator means being moveable between a first actuator position corresponding to a first extreme cutting length of the cutting length range, and a second actuator position corresponding to a second extreme cutting length of the cutting length range;

a control means moveable between a plurality of control positions including:

a range of length control positions between a first control position corresponding to the first actuator position and a second control position corresponding to the second actuator position; and an off position corresponding to deactivation of the motor, wherein the cutting means comprises a follower means for contacting the guard means and for driving the guard means and cooperating with the actuator means so that, when the actuator means engages the follower means, movement of the actuator means between the first actuator position and the second actuator position causes movement of the follower means which causes movement of the guard means, resulting in a corresponding variation of the cutting length between the first extreme cutting length of the cutting length range and the second extreme cutting length of the cutting length range, whereby, in use, the actuator means is in the first actuator position when the drive means is deactivated by movement of the control means to the off position, such that the follower means moves to a first follower position corresponding to an engagement with the actuator means in the first actuator position.

18. The hair cutting device according to claim 17, wherein the off position is adjacent the first control position, and wherein the cutting means is detachably mountable on the drive means.

19. A hair cutting device comprising:

a cutter unit having a guard, the guard being configured to vary a cutting length of the cutter unit within a cutting length range;

a driver unit configured to receive the cutter unit, driver unit comprising:

a motor configured to drive the cutter unit;

an actuator configured to cooperate with the guard to vary the cutting length of the cutter unit within the cutting length range, the actuator being moveable between a first actuator position corresponding to a first extreme cutting length of the cutting length range, and a second actuator position corresponding to a second extreme cutting length of the cutting length range;

a controller moveable between a plurality of control positions including:

a range of length control positions between a first control position corresponding to the first actuator position and a second control position corresponding to the second actuator position; and an off position corresponding to deactivation of the motor, wherein the cutter unit comprises a follower configured to contact the guard and to drive the guard and cooperate with the actuator so that, when the actuator engages the follower, movement of the actuator between the first actuator position and the second actuator position causes movement of the follower which causes movement of the guard, resulting in a corresponding variation of the cutting length between the first extreme cutting length of the cutting length range and the second extreme cutting length of the cutting length range, whereby, in use, the actuator is in the first actuator position when the drive is deactivated by movement of the controller to the off position, such that the follower moves to a first follower position corresponding to engagement with the actuator in the first actuator position.

20. The hair cutting device according to claim 19, wherein the off position is adjacent the first control position, and wherein the cutter unit is detachably mountable on the driver unit.

* * * * *